US006344842B1

(12) United States Patent
Hebiguchi

(10) Patent No.: US 6,344,842 B1
(45) **Date of Patent: *Feb. 5, 2002**

(54) LIQUID CRYSTAL DISPLAY DEVICE AND A DRIVING METHOD THEREFOR

(75) Inventor: Hiroyuki Hebiguchi, Miyagi-ken (JP)

(73) Assignees: LG. Phillips LCD Co., Ltd., Seoul (KR); Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/746,784

(22) Filed: Nov. 15, 1996

(30) Foreign Application Priority Data

Nov. 30, 1995 (JP) ..... 7-313264

(51) Int. Cl.[7] ..... G09G 3/36
(52) U.S. Cl. ..... 345/96
(58) Field of Search ..... 345/93–98, 205–206, 345/208–210

(56) References Cited

U.S. PATENT DOCUMENTS 5,173,687 A * 12/1992 Tanaka et al. ..... 345/94
5,252,954 A * 10/1993 Nagata et al. ..... 345/95
5,280,279 A * 1/1994 Makazawa et al. ..... 345/38
5,402,142 A * 3/1995 Okada et al. ..... 345/94
5,438,342 A * 8/1995 Yamaguchi ..... 345/96
5,666,133 A * 9/1997 Matsuo et al. ..... 345/96
5,670,970 A * 9/1997 Yamazaki ..... 345/96
5,724,057 A * 3/1998 Kimura et al. ..... 345/209
5,745,194 A * 4/1998 Nakashima et al. ..... 349/38
5,748,169 A * 5/1998 Okumura et al. ..... 345/90
5,757,349 A * 5/1998 Togashi ..... 345/96
5,923,320 A * 7/1999 Murakami et al. ..... 345/179
6,005,543 A * 12/1999 Kimura ..... 345/94

FOREIGN PATENT DOCUMENTS

JP 55-6916 2/1980

* cited by examiner

*Primary Examiner*—Richard Hjerpe
*Assistant Examiner*—Ronald Laneau
(74) *Attorney, Agent, or Firm*—Brinks Hofer Gilson & Lione

(57) ABSTRACT

A liquid crystal display device has a pair of substrates, one of which is provided with a thin-film-transistor circuit, the other one of which is provided with a common electrode, with liquid crystal provided therebetween. The thin-film-transistor circuit includes thin-film-transistors and pixel electrodes in regions surrounded by both gate lines and source lines arranged in the form of a matrix. When the liquid crystal display device is driven, the polarity of an electric signal to be applied to the liquid crystal is fixed corresponding to a plurality of frames or fields, or all frames or fields.

24 Claims, 8 Drawing Sheets

LIQUID CRYSTAL DISPLAY DEVICE AND A DRIVING METHOD THEREFOR

BACKGROUND OF THE INVENTION

1. Field of the Invention

This invention relates to techniques for inverting the polarity of an electric signal which is applied to liquid crystal so as to correspond to a plurality of frames or fields, when a liquid crystal display device is driven.

2. Description of the Related Art

In general, a thin-film-transistor (TFT) color liquid crystal display device includes a TFT substrate on which gate lines (scanning lines) and data lines (signal lines) are arranged, and another color filter substrate on which a common electrode is disposed. In this TFT liquid crystal display device, basically, a scanning signal is applied to the gate lines, while a corresponding display signal is applied to the source lines, so that matrix operation is performed, and pixels realize a high-quality image by performing a charge holding operation.

"Driving by scanning" means that a horizontal line of pixels is selected and a display signal is applied to the selected line. In driving a liquid crystal display device, the application of a direct current signal causes ions in liquid crystal to gather on one substrate, often resulting in deterioration of its liquid crystal display. To prevent this phenomenon, the liquid crystal display device is driven by positively and negatively inverting the applied display signal so as to correspond to each field.

Further, as disclosed in Japanese Patent Publication No. 55-6916, there is a known technique for driving a liquid crystal display device with an alternating current having symmetrically positive and negative polarity by inverting the polarity of an electric signal to be applied to the liquid crystal so that direct current components of the signal are not included in the applied signal.

As mentioned above, when the TFT color liquid crystal display device is driven with an alternating current by positively and negatively inverting the display signal, corresponding to each field, a signal sent from a signal line is inverted and the inverted signal is inputted to pixels. Conventionally, there are several methods for inverting the signal sent from the signal line. The simplest method is "inversion-to-field" in which a signal sent from a signal line is inverted in units of fields, corresponding to pixels.

Other methods which are employed are "inversion-to-gate-line" in which a cycle of the inversion corresponds to each scanning line, and "inversion-to-data-line" in which a cycle of the inversion corresponds to each signal line. In addition, in order to eliminate cross-talk and insufficient writing more efficiently than these two methods, "driving-by-inversion-to-dot" in which a signal is inverted corresponding to adjacent dots is also employed.

By referring to FIGS. 7 and 8, both the occurrence mechanism of a sticking phenomenon and the occurrence mechanism of flickers in a liquid crystal device will be described below.

FIG. 7A shows the most general schematic structure of a liquid crystal cell that constitutes a liquid crystal display device. A condition in which liquid crystal 1 is encapsulated between a pair of transparent substrates is shown. On both electrodes with respect to the liquid crystal 1, electrode layers 2 and 3, insulating films 4 containing SiNx thereon, and orientation films 5 containing polyimide thereon are generally formed. FIG. 7A also shows a condition in which a voltage is not applied to the liquid crystal cell, and ions which are inevitably present in the liquid crystal 1 are dispersed at random.

When a direct current voltage is applied to the liquid crystal cell as shown in FIG. 7B, this voltage causes the ions present in the liquid crystal 1 to be polarized and absorbed to the surfaces of the orientation films 5. In other words, since the SiNx-contained insulating films 4 and the polyimide-contained orientation films 5 (both are insulating films) are present on the electrode layers 2 and 3 in the liquid crystal cell, which is conventional, the ions are absorbed to form capacitors $C_{SINx\cdot PI}$ between the surfaces of the orientation films 5 and the surfaces of the electrode layers 2 and 3.

When the capacitors $C_{SINx\cdot PI}$ is formed, an asymmetric voltage $V_{AS}$ (voltage generated by sticking) is generated by the absorbed ions. As shown in FIG. 7C, in the liquid crystal cell a relationship expressed as $V_{AS}=Q_{ion}/C_{SINx\cdot PI}$ is established, where $Q_{ion}$ represents the charges of the absorbed ions.

In a condition in which the above-described sticking occurs and the absorbed ions are fixed, as shown in FIG. 7C, when the voltage between the electrode layers 2 and 3 is expressed as $V_0$, a relationship expressed as $V_0=V_{AS1}$ (asymmetric voltage to the electrode layer 2)$+V_{AS2}$ (asymmetric voltage to the electrode layer 3)$+V_{Lc}$ (actually applied voltage to the liquid crystal 1) is established. If an applied voltage from the exterior is set to zero with this condition, a voltage expressed as $V_{LC}=V_{AS1}+V_{AS2}=V_{AS}$ is applied to the liquid crystal cell as shown in FIG. 7D. This is the result of the sticking, which affects display quality, as a residual image in display. Further, if the liquid crystal cell is driven with an alternating current, the voltage of $V_{AS}$ is a factor in the occurrence of flickers.

The occurrence mechanism of flickers will be described below.

To avoid sticking caused by driving the liquid crystal with a direct current as described above, the liquid crystal is driven with an alternating current as shown in FIG. 8A. In a condition in which the liquid crystal is driven with an alternating current while the asymmetric voltage ($V_{AS}$) is being generated, even when the voltage $\pm V_0$ is applied, in connection with the signal applied to one pixel as shown in FIG. 8B, the positive polarity has a relationship expressed as $V_0-V_{AS}=|V_{LC}|$ and the negative polarity has a relationship expressed as $V_0+V_{AS}=|VLC|$, so that the applied voltage has different magnitude in polarity.

When the electro-optic characteristics of the liquid crystal is as shown in FIG. 8C, in other words, when the relationship of transmittance (T) with respect to applied voltage (V) is represented by a curve shown in FIG. 8C, transmittance of $T(V_0)$ must be obtained with respect to the applied voltage ($V_0$). However, this case has asymmetric voltage $V_{AS}$, the transmittance differs depending upon the polarity. The transmittance in the positive and negative polarities are expressed as follows:

transmittance in positive polarity $T(V_0-V_{AS})$;

transmittance in negative polarity $T(V_0+V_{AS})$.

Consequently, flickers occur, and the amplitude of a change in the transmittance is expressed as the following relationship: $\Delta T=T(V_0-V_{AS})-T(V_0+V_{AS})$ Based on the described background, the liquid crystal is driven by inverting the signal. Such driving by inversion needs voltage amplitude which is twice as much as necessary voltage amplitude for normally driving the liquid crystal, resulting in large power consumption. For example, if a voltage necessary for driving the liquid crystal is 5 V, a signal needs to have 10 V (namely, ±5 V) in positive and negative polarity.

In addition, power consumption P caused by such a driving signal is generated by charging or discharging the liquid crystal cell serving as a capacitor at the inverting frequency of the signal. Thus, the following relationship is established:

$$Pf, V_2$$

where P represents power consumption; f, the inverting frequency of the signal; and V, voltage. As expressed in the above relationship, P is proportional to f, and P is proportional to $V^2$.

Therefore, power consumption necessary for applying the source voltage ($V_{sig}$) when the polarity of the signal is inverted needs to be not less than four times greater than power consumption when the polarity is not inverted, so that a problem of large power consumption occurs. Further, if the inverting frequency is considered, the difference between the two cases becomes larger.

SUMMARY OF THE INVENTION

Accordingly, in view of the foregoing problems, it is an object of the present invention to provide a liquid crystal display device and a driving method therefor, which device can reduce power consumption, have increased numerical aperture, correct a change in its electro-optic characteristics caused by a sticking phenomenon, and realize gradation display, contrast and flickering as designed.

In accordance with an aspect of the present invention, the foregoing object is achieved through the provision of a liquid crystal display device having a pair of substrates, one of which is provided with a thin-film-transistor circuit, the other one of which is provided with a common electrode, with liquid crystal provided therebetween, the thin-film-transistor circuit including thin-film-transistors and pixel electrodes in regions surrounded by both gate lines and source lines arranged in the form of a matrix, wherein, when the liquid crystal display device is driven, the polarity of an electric signal to be applied to the liquid crystal is fixed corresponding to a plurality of frames or fields, or all frames or fields.

Preferably, an offset voltage whose polarity is the same as the polarity of an asymmetric voltage generated by sticking in the liquid crystal is included in the signal for driving.

Preferably, the liquid crystal cell of the liquid crystal display device is forced to have sticking, and an offset voltage whose polarity is the same as the polarity of an asymmetric voltage generated by the sticking is included in the signal for driving.

In accordance with another aspect of the present invention, the foregoing object is achieved through the provision of A driving method for a liquid crystal display device having a pair of substrates, one of which is provided with a thin-film-transistor circuit, the other one of which is provided with a common electrode, with liquid crystal provided therebetween, the thin-film-transistor circuit including thin-film-transistors and pixel electrodes in regions surrounded by both gate lines and source lines arranged in the form of a matrix, wherein the driving method includes the step of fixing the polarity of an electric signal to be applied to the liquid crystal so as to correspond to a plurality of frames or fields, or all frames or fields.

Preferably, the driving method includes the step of including an offset voltage whose polarity is the same as the polarity of an asymmetric voltage generated by sticking in the liquid crystal in the signal for driving.

Preferably, the driving method includes the steps of: forcing the liquid crystal cell of the liquid crystal display device to have sticking; and including an offset voltage whose polarity is the same as the polarity of an asymmetric voltage generated by the sticking in the signal for driving.

As described above, in accordance with the present invention, the polarity of an electric signal to be applied to liquid crystal is fixed corresponding to a plurality of frames or fields when the liquid crystal device is driven. Thus, power to be applied across the electrodes is reduced much less than that in the conventional liquid crystal device.

In the conventional structure or driving method that utilizes "driving-by-inversion-to-line" in which a liquid crystal device is driven by oppositely inverting the polarity of a signal so as to correspond to each line, "driving-by-inversion-to-dot" in which a liquid crystal device is driven by inverting the polarity of a signal so as to correspond to each dot, a difference in voltages applied to pixel electrodes both adjacent to the gate electrode is large, its polarity being inverted, and as a result, there is considerable irregularity in the direction of an electric field in proximity to the gate electrode, and in this portion irregularity readily occurs in the orientation of liquid crystal. However, in accordance with the structure or driving method of the present invention, a difference in voltages applied to pixel electrodes both adjacent to the gate electrode is small, the polarity of these voltages being almost not inverted, and as a result, there is small irregularity in the direction of the electric field in proximity to the gate electrode, and in this portion irregularity hardly occurs in the orientation of liquid crystal. In particular, when the polarity of the signal is not inverted at all, an advantage in which inversion of the polarity of the electric field does not occur in the whole liquid crystal cell is obtained.

Consequently, the conventional structure has regions covered with a black mask for the orientation irregularity to hardly be seen, while the present invention provides regions without being covered are expanded, which advantageously increases a numerical aperture for a liquid crystal device. Accordingly, by employing the structure according to the present invention, the brightness of a liquid crystal display device can be enhanced when the power consumption of its backlight is the same as that in the conventional liquid crystal display device, in addition, when its brightness is similar to conventional, power consumption resulting from reduced power consumption in its backlight can be reduced.

In addition, when an asymmetric voltage is generated by sticking in liquid crystal, by including an offset voltage whose polarity is the same as the polarity of an asymmetric voltage generated by sticking to the liquid crystal in the signal for driving, the liquid crystal cannot be affected by this asymmetric voltage, and flickers can be suppressed. Accordingly, gradation display, contrast and flickers are advantageously realized as designed.

DESCRIPTION OF THE PREFERRED EMBODIMENTS

By referring to the attached drawings, embodiments of the present invention will be described below.

Figure 1:
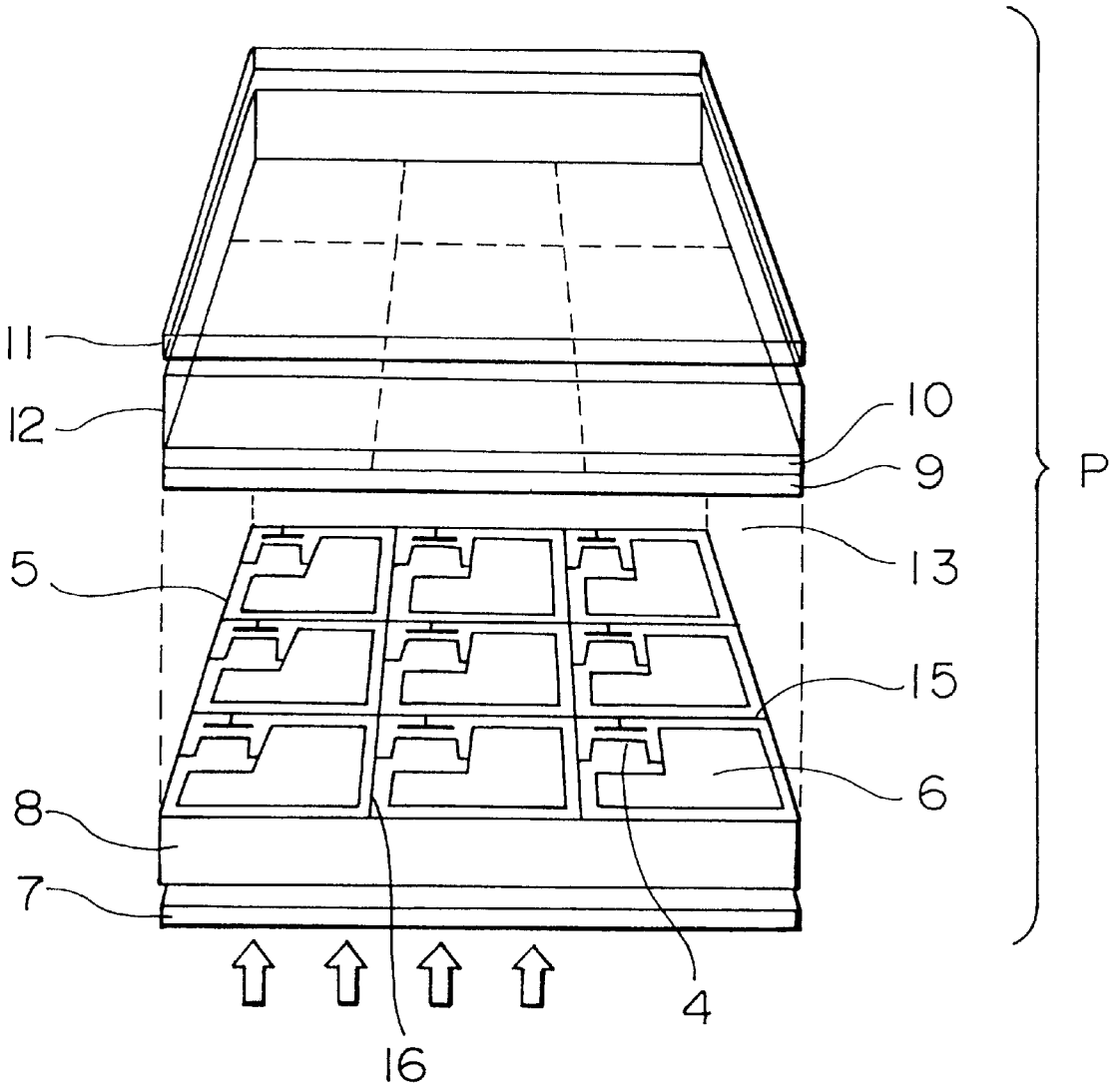
FIG. 1 is a perspective exploded view illustrating a TFT color liquid crystal display device according to an embodiment of the present invention.
Figure 2:
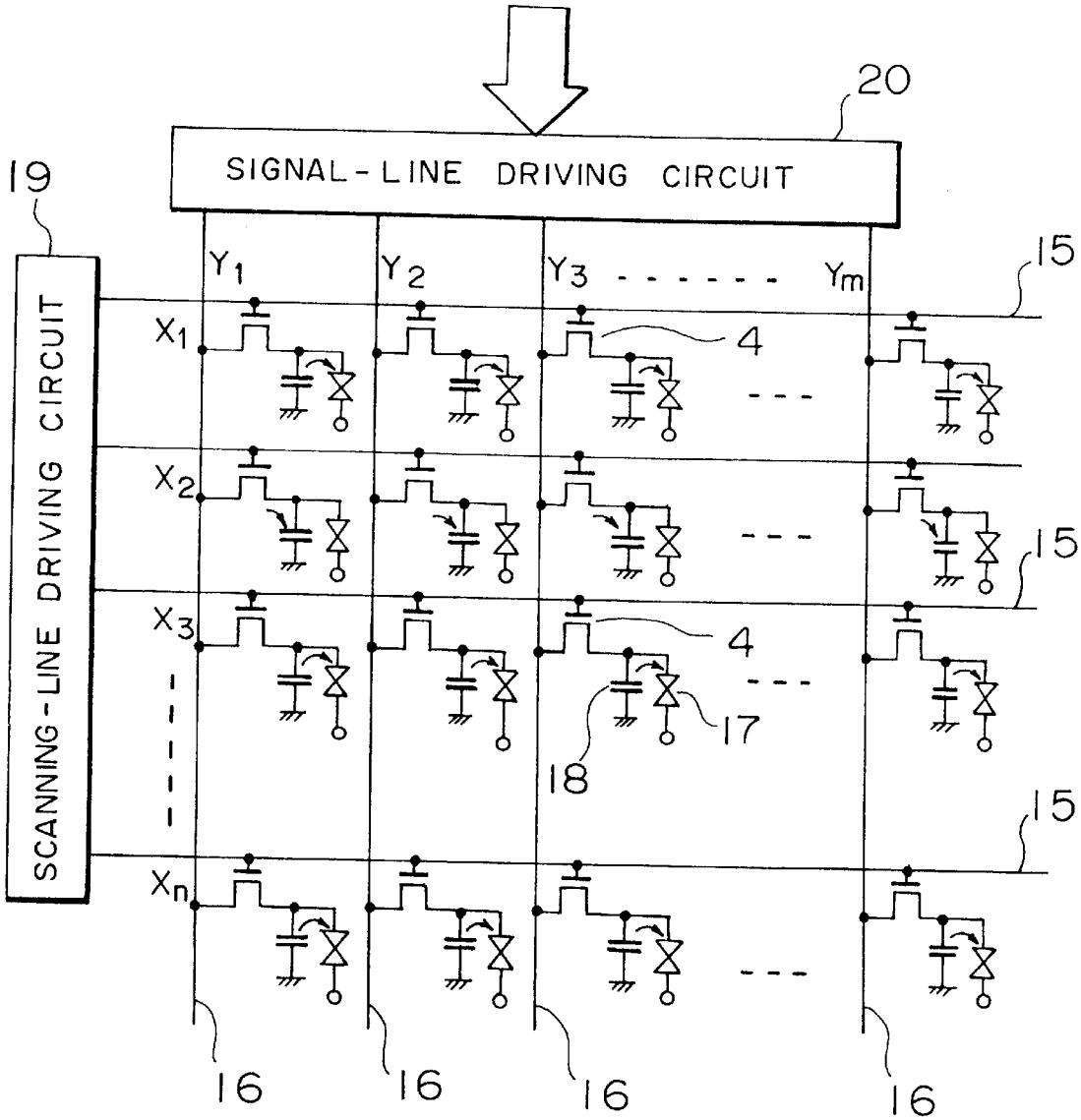
FIG. 2 is an equivalent circuit diagram showing the TFT circuits of the TFT color liquid crystal display shown in FIG. 1.

FIG. 1 shows the basic structure of a liquid crystal cell in a TFT color liquid crystal display device according to an embodiment of the present invention. FIG. 2 shows the equivalent circuits of this TFT liquid crystal display device. This liquid crystal cell P includes a transparent substrate on which a plurality of TFT circuits 5 and pixel electrodes 6 are formed and a polarizing plate 7 is mounted, a transparent substrate 12 on which a common electrode 9 and a micro-filter 10 are mounted, and liquid crystal encapsulated between both substrates 8 and 12 oppositely disposed over a predetermined distance 13.

These TFT circuits 5 include TFTs 4 and pixel electrodes 6 formed in regions surrounded with a plurality of gate lines 15 and source lines 16 disposed in the form of a matrix, liquid crystal materials 17 connected to the TFTs 4, which materials function as capacitors in the equivalent circuits, and storage capacitors 18 for storing signal charges.

The respective gate lines 15 serving as scanning lines are connected to a scanning-line driving circuit 19, while the respective source lines 16 serving as signal lines are connected to a signal-line driving circuit 20.

Figure 3A:
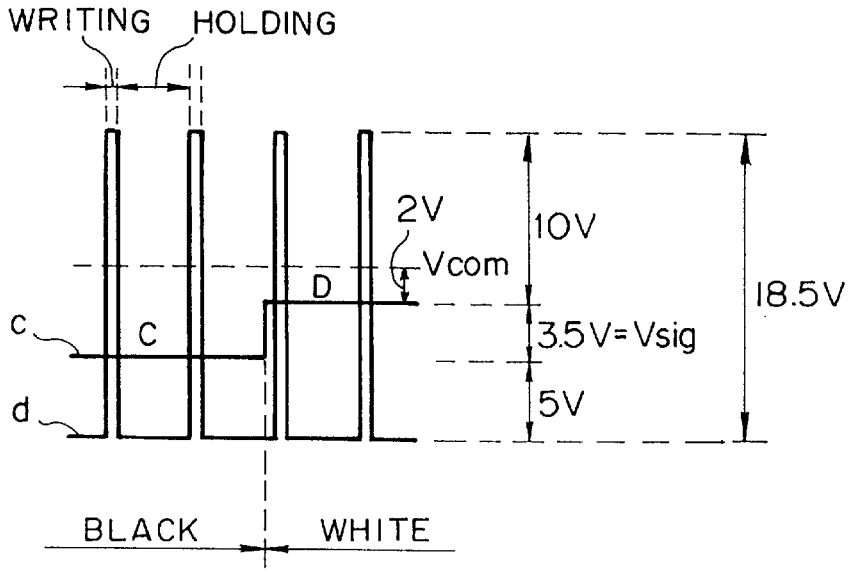
FIG. 3A is a waveform chart showing a signal applied to one pixel, according to the present invention.

The liquid crystal device P displays an image such that this scanning-line driving circuit 19 and this signal-line driving circuit 20 input signals shown in FIG. 3A to each pixel electrode 6. In other words, the signal-line driving circuit 20 inputs the signal so that the signal is not inverted over a few frames or more, or is not completely inverted, without positively or negatively inverted. The scanning-line driving circuit 19 inputs a pulse signal having a predetermined duration, similar to a pulse signal the known art.

Before the description of the details of the driving according to the present invention and effects thereof, a condition in which the liquid crystal of a conventional liquid crystal device is driven by inverting the polarity of a signal so as to correspond to each line or dot and is driven by a conventional scanning-line driving circuit and a conventional signal-line driving circuit will be described by referring to FIGS. 4A, 4B and 4C.

Figure 4A:
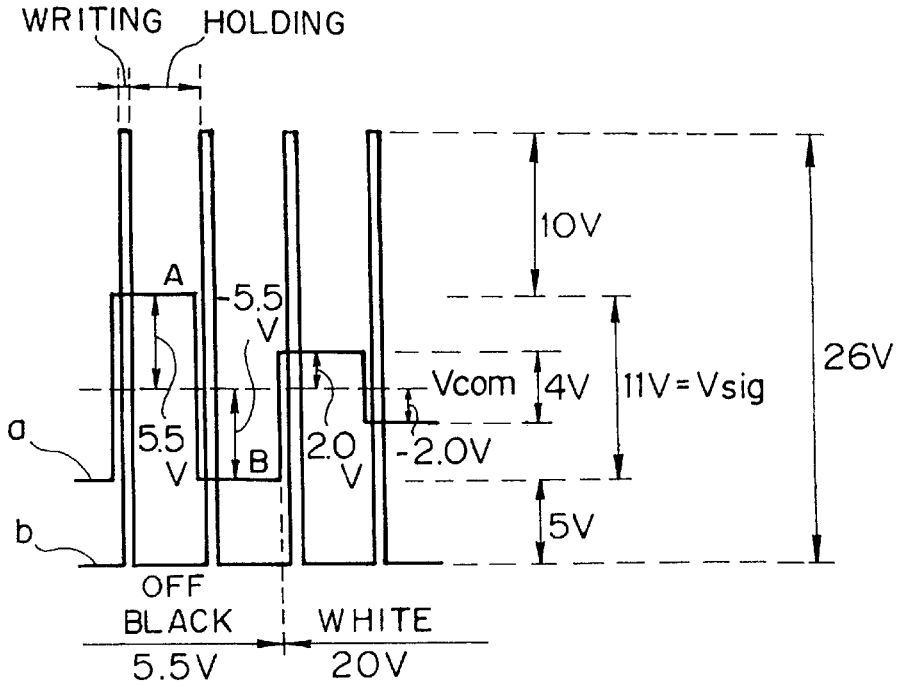
FIG. 4A is a waveform chart showing a signal applied to one pixel in a conventional liquid crystal cell.

FIG. 4A shows the waveform of a signal applied to one pixel when normal white-display liquid crystal is used and the black level is set to 5.5 V, where $V_{com}$ represents the voltage of a common-side electrode formed on one of two substrates provided with the liquid crystal when the liquid crystal is driven by inverting the signal, which voltage is represented by a dashed line.

In general, for displaying black based on this common voltage ($V_{com}$), as signal-line driving source waveform a, a positive voltage of +5.5 V or a negative voltage of −5.5 V is applied in the form of pulses at a constant cycle (in the inversion-with-line the polarity is inverted corresponding each line, while in the inversion-with-dot the polarity is inverted corresponding to each dot). For displaying white, a positive voltage of +2.0 V or a negative voltage of −2.0 V is applied at a constant cycle (in the inversion-with-line the polarity is inverted corresponding each line, while in the inversion-with-dot the polarity is inverted corresponding to each dot). Consequently, a signal voltage ($V_{sig}$) applied to the electrode on the other substrate for displaying black is expressed as 5.5 V×2=11 V, and a signal voltage ($V_{sig}$) for displaying white is expressed as 2.0×2=4 V.

In addition, writing is performed by using pulses having a scanning-line driving waveform b obtained by using a voltage of −10.5 V as an OFF voltage which is 5 V lower than the negative voltage −5.5 V of the signal-line driving waveform a, and by using a waveform which is approximately 10 V higher than the positive voltage +5.5 V of the signal-line driving waveform a, with a reference set to the OFF voltage. Thereby, a writing current is maintained until successive pulses are sent. This voltage of 10 V is necessary to maintain the writing current.

Figure 4B:
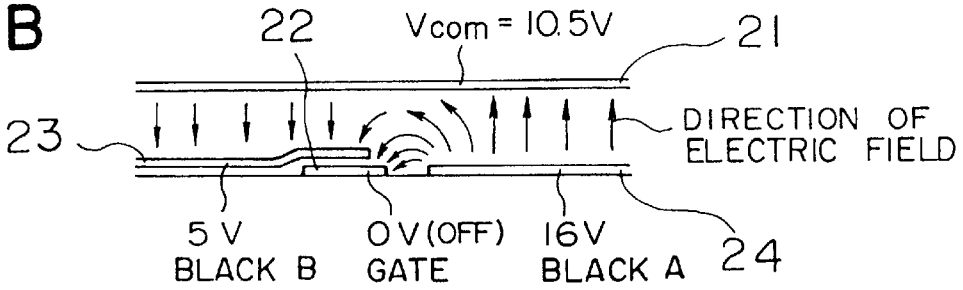
FIG. 4B is a section view illustrating the direction of an electric field in an intersection of a source and a gate in the conventional liquid crystal cell

FIG. 4B is the cross-cut main structure of the liquid crystal cell, showing a region between an upper common electrode 21 and pixel electrodes 23, 24 adjacent to a lower gate electrode 22 in the cell. When this gate electrode 22 is in the OFF status at 0 V, a common voltage $V_{com}$ of 10.5 V is applied to the common electrode 22, based on the relationship shown in FIG. 4A, a voltage which is +5 V higher than the OFF voltage of the scanning-line driving waveform b in displaying black, represented by reference alphabet B, is applied to the pixel electrode 23 shown on the left of FIG. 4B, and a voltage which is +16 V higher than the OFF voltage of the scanning-line driving waveform b, represented by reference alphabet A, in displaying black by inversion is applied to the pixel electrode 24 shown on the right of FIG. 4B.

In other words, in the signal waveform A shown in FIG. 4A, a relationship expressed as $V_{GS}$=−16 V is established, where $V_{GS}$ represents the voltage between the gate and source of a TFT when holding signal charges, while in the signal waveform B shown in FIG. 4B, a relationship expressed as $V_{GS}$=−5 V is established.

In the direction of an electric field in this case, represented by an arrow shown in FIG. 4B, irregularity occurs between the pixel electrodes 23 and 24 adjacent to the gate electrode 22. Since such irregularity in the electric field causes irregularity in the orientation of the liquid crystal (disclination), a black mask is disposed on a transparent substrate on which the common electrode 21 is formed to conceal the irregularity in the electric field. However, the numerical aperture of the liquid crystal device is disadvantageously reduced.

Figure 4C:
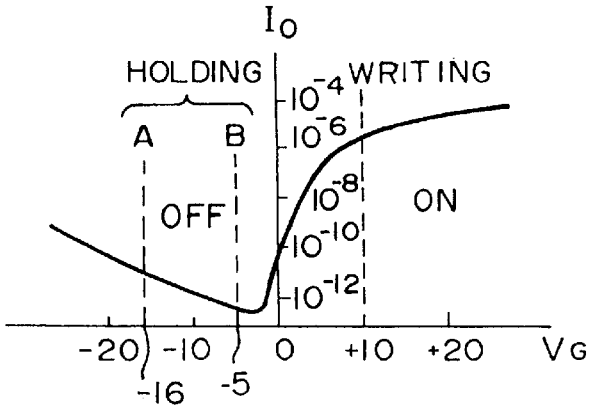
FIG. 4C is a graph showing the relationship between the gate voltage and drain voltage of a conventional TFT.

FIG. 4C shows the relationship between the gate voltage ($V_G$) and drain current ($I_D$) of a general n-channel type TFT. When a liquid crystal device that includes TFTs having the relationship is driven by inverting the polarity of a signal so as to correspond to each line or dot, with the potential differences shown in FIGS. 4A and 4B, the range between −5 V to −16 V is used as the gate voltage ($V_G$) shown in FIG. 4C. Thus, a region in which the drain current ($I_D$) increases must be used. Accordingly, the TFT leak current in this case is expressed as $I_D>1\times10^{-11}$ A when the signal waveform A shown in FIG. 4A is used, and as $I_P\approx1\times10^{-12}$ A when the signal waveform B shown in FIG. 4A is used.

The above-mentioned problems in the conventional structure of the liquid crystal device and the conventional driving method therefor can be eliminated by the present invention.

For example, FIG. 3A shows the waveform of a signal applied to one pixel when normal white-display liquid crystal is used and the black level is set to 5.5 V, where $V_{com}$ represents the voltage of a common-side electrode formed on one of two substrates provided with the liquid crystal therebetween when the liquid crystal is driven by the signal, which voltage is represented by a dashed line.

For displaying black, based on this common voltage ($V_{com}$), as signal-line driving source waveform c, a negative voltage of −5.5 V is applied in the form of pulses at a constant cycle (for example, over 3 fields). For displaying white, a negative voltage of −2.0 V is applied at a constant cycle (for example, over 3 fields). Consequently, a signal voltage ($V_{sig}$) applied to the electrode on the other substrate for displaying black is expressed as 5.5 V−2 V=3.5 V, as shown in FIG. 3A.

In addition, writing is performed by using pulses having a scanning-line driving waveform d obtained by using, as an OFF voltage, a voltage which is 5 V lower than the minimum voltage −5 V of the signal-line driving waveform c, and by using a waveform which is approximately 10 V higher than the maximum voltage −2 V of the signal-line driving waveform c, with a reference set to the OFF voltage. Thereby, a writing current is maintained until successive pulses are sent. This voltage of 10 V is necessary to maintain the writing current.

Figure 3B:
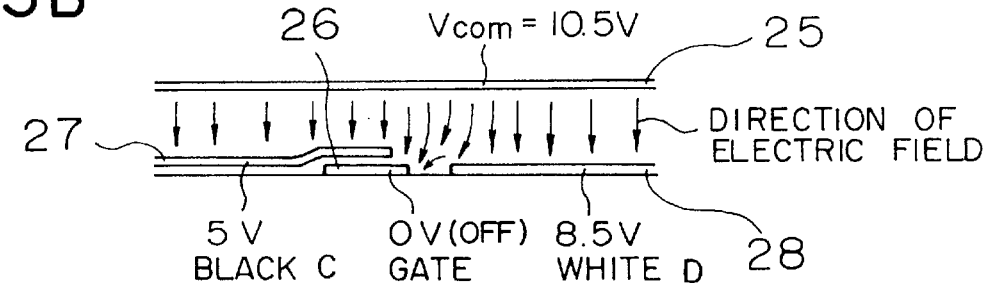
FIG. 3B is a section view illustrating the direction of an electric field in an intersection of a source and a gate in a liquid crystal cell according to the present invention.

FIG. 3B is the cross-cut main structure of the liquid crystal cell P according to the present invention, showing a region between an upper common electrode 25 and pixel electrodes 27, 28 adjacent to a lower gate electrode 26 in the cell. When this gate electrode 26 is in the OFF status at 0 V, a common voltage $V_{com}$ of 10.5 V is applied to the common electrode 25, based on the relationship shown in FIG. 3A, a voltage of +5 V which is higher than the OFF voltage of the scanning-line signal waveform d, represented by reference alphabet C, in displaying black is applied to the pixel electrode 27, and a voltage of +8.5 V which is higher than the OFF voltage of the scanning-line signal waveform d, represented by reference alphabet D, in displaying black by inversion is applied to the pixel electrode 28.

In other words, in the waveform c of the scanning-line signal source waveform shown C in FIG. 3A, a relationship expressed as $V_{GS}$=−5 V is established, where $V_{GS}$ represents the voltage between the gate and source of a TFT when holding signal charges, while in the waveform D shown in FIG. 3B, $V_{GS}$=−8.5 V.

In the direction of an electric field in this case represented by an arrow shown in FIG. 3B, almost no irregularity occurs between the pixel electrodes 27 and 28 adjacent to each other with the gate electrode 26 therebetween, so that irregularity (disclination) in the orientation of liquid crystal hardly occurs. Accordingly, a region for a black mask on the substrate on which the common electrode 25 is formed can be reduced to increase the numerical aperture of the liquid crystal device. Therefore, the employment of the structure according to the present invention can enhance the brightness of the liquid crystal cell P if the power consumption is the same as in the conventional liquid crystal device, and can reduce the power consumption of the cell by reducing the power consumption of the backlight.

Figure 3C:
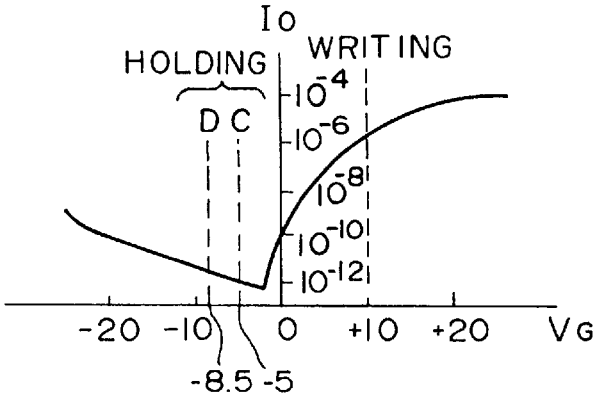
FIG. 3C is a graph showing the relationship between the gate voltage and drain voltage of a TFT according to the present invention.

FIG. 3C shows the relationship between the gate voltage ($V_G$) and drain current ($I_D$) of a general n-channel type TFT. When a liquid crystal device that includes TFTs having the relationship is driven in the condition shown in FIGS. 3A and 3B, the range between −5 V to −8.5 V is used as the gate voltage ($V_G$) shown in FIG. 3C. Advantageously, a region in which an increase in the drain current ($I_D$ in the OFF status is small can be used.

Consequently, in the waveform C of the signal-line driving source waveform c, $I_D\approx1\times10^{-12}$ A, while in the waveform D of the signal-line source waveform c, $I_D\approx1\times10^{-}$ A, which waveforms are evidently superior to the waveforms A and B shown in FIG. 4A. In other words, in the present invention a condition of the liquid crystal is efficiently maintained.

In driving the liquid crystal device by inverting the signal so as to correspond to each line or dot, as described above referring to FIGS. 4A to 4C, the signal voltage $V_{sig}$ applied from the signal-line driving circuit must be set to 11 V. However, in driving the liquid crystal device according to the present invention, as described referring to FIGS. 3A to 3C, particularly in the driving by non-inversion the signal voltage $V_{sig}$ may be set to 3.5 V, so that the voltage consumption in the signal-line driving circuit 20 can be increasingly reduced. Also the gate voltage can be reduced from a conventional voltage of 26 V to 18.5 V, as shown in FIG. 3A.

Figure 5A:
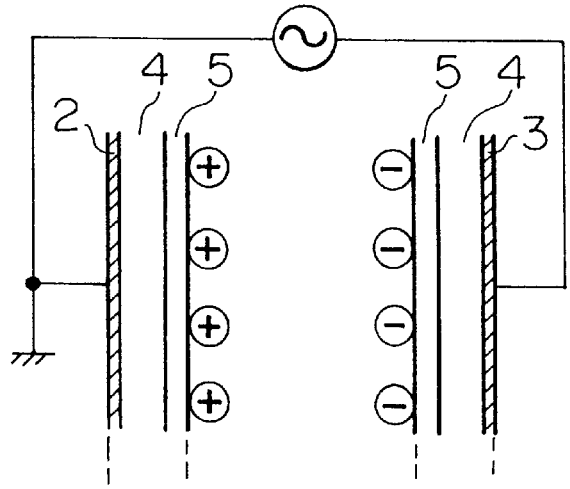
FIG. 5A is a section view illustrating a condition in a conventional liquid crystal cell has sticking.
Figure 5B:
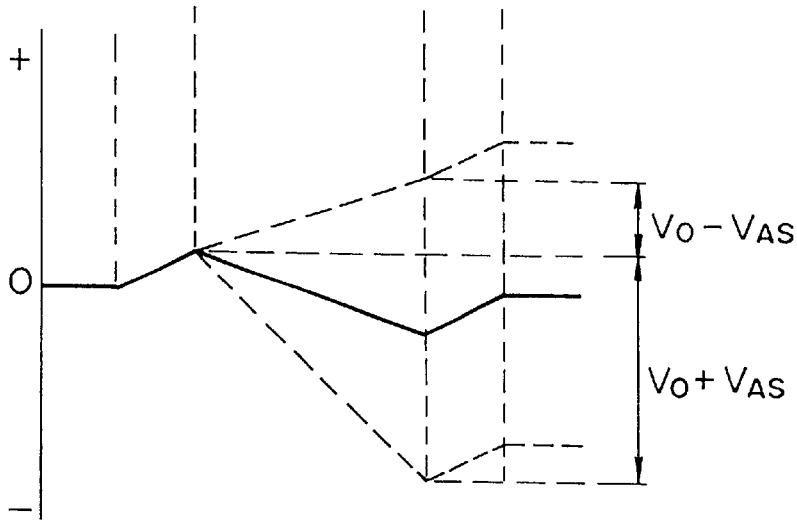
FIG. 5B is a graph showing the voltages of portions of the conventional liquid crystal cell having sticking.
Figure 5C:
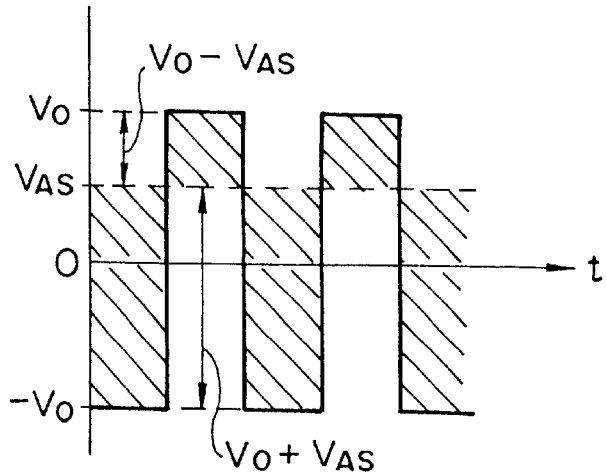
FIG. 5C is a graph showing a driving signal used in the conventional liquid crystal cell having sticking.

FIGS. 5A, 5B and 5C show a condition in which liquid crystal is being driven without the application of the offset voltage thereto when an asymmetric voltage ($V_{AS}$) caused by sticking is present. In this condition positive and negative voltages are differently applied to the liquid crystal to generate flickers.

When the offset voltage is not present,

Positive voltage applied to liquid crystal: $V_{LC}=V_0-V_{AS}$

Negative voltage applied to liquid crystal: $V_{LC}=V_0+V_{AS}$

Figure 6A:
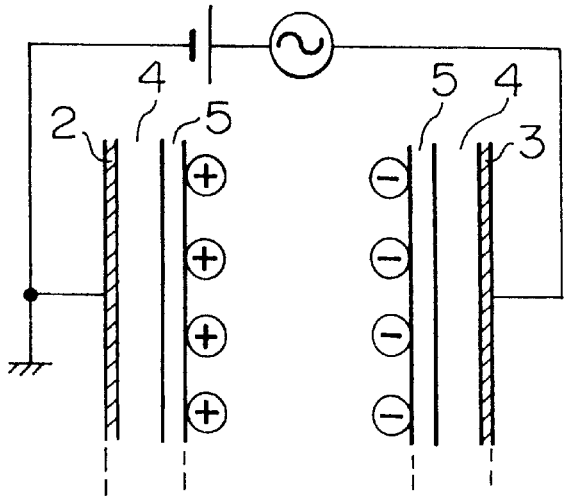
FIG. 6A is a section view illustrating a condition in a liquid crystal cell according to the present invention has sticking.
Figure 6B:
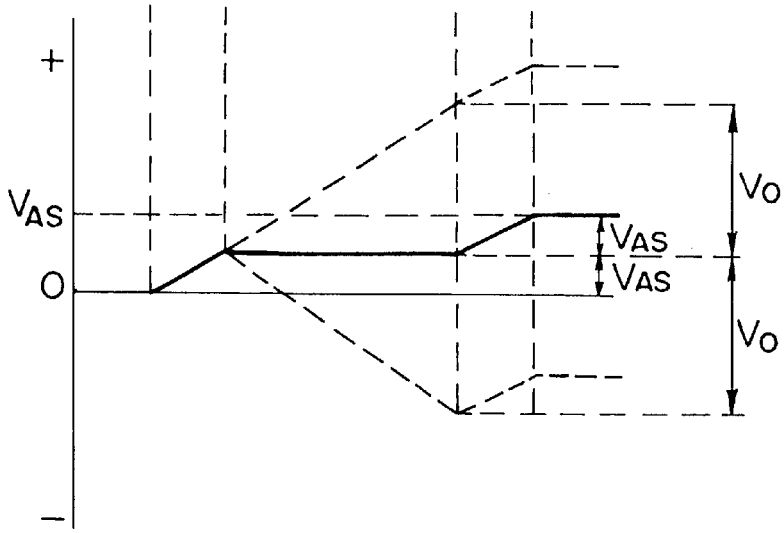
FIG. 6B is a graph showing the voltages of portions of the liquid crystal cell according to the present invention having sticking.
Figure 6C:
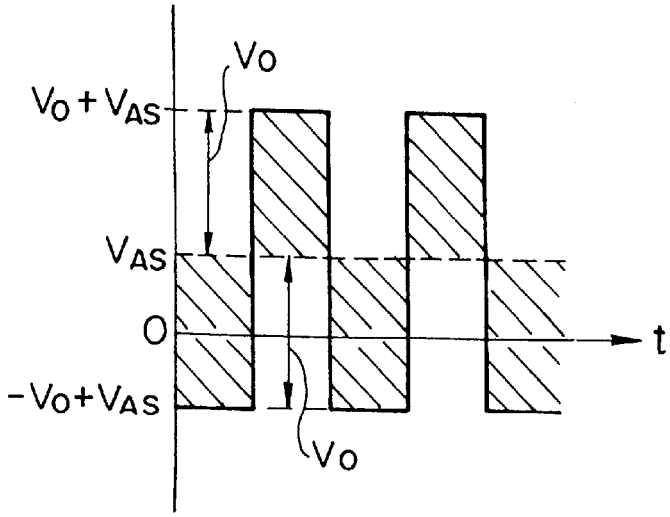
FIG. 6C is a graph showing a driving signal used in the liquid crystal cell according to the present invention having sticking.
Figure 7A:
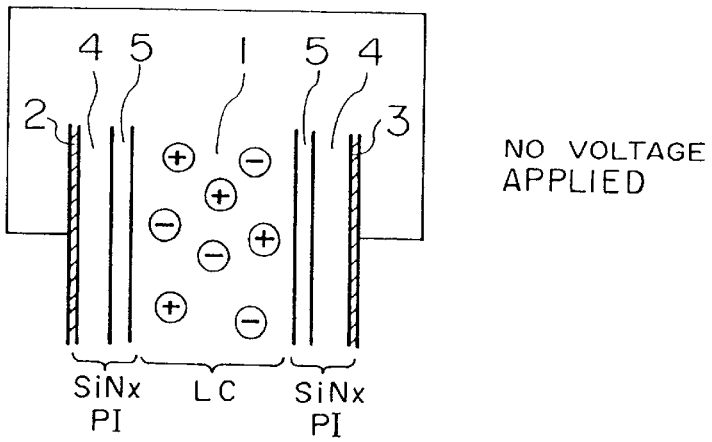
FIG. 7A PRIOR ART
FIG. 7A is a section view illustrating the distribution of ions in the liquid crystal of a conventional liquid crystal cell to which no voltage is applied.
Figure 7B:
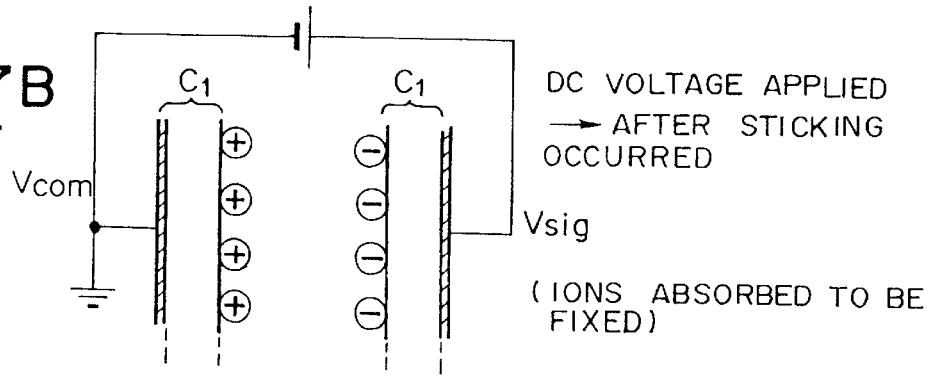
FIG. 7B PRIOR ART
FIG. 7B is a section view illustrating a condition in which the conventional liquid crystal cell has sticking.
Figure 7C:
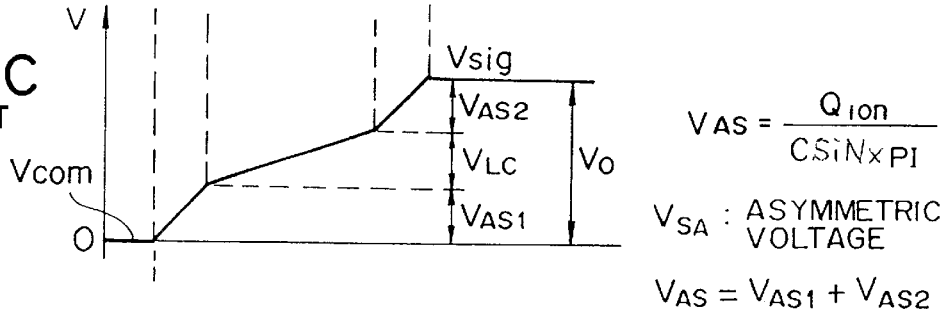
FIG. 7C PRIOR ART
FIG. 7C is a graph showing the voltages of portions of the conventional liquid crystal cell.
Figure 7D:
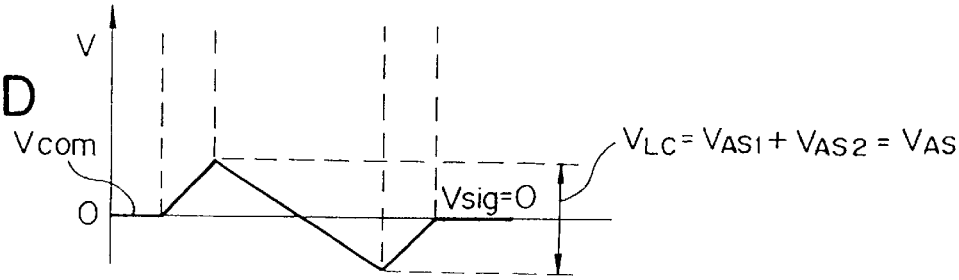
FIG. 7D PRIOR ART
FIG. 7D is a graph showing the voltages of portions of the conventional liquid crystal cell when a driving voltage is zero.
Figure 8A:
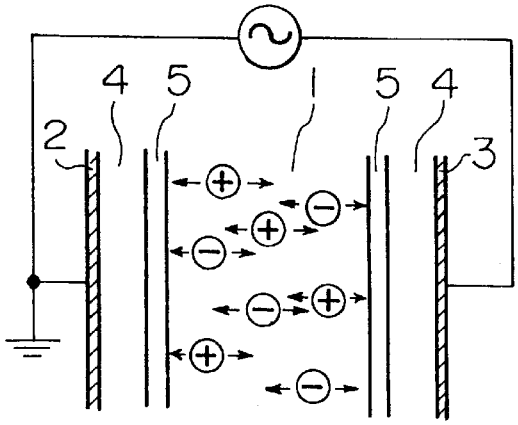
FIG. 8A is a section view illustrating the distribution of ions in the liquid crystal of the conventional liquid crystal cell when is driven by an a.c. signal.
Figure 8B:
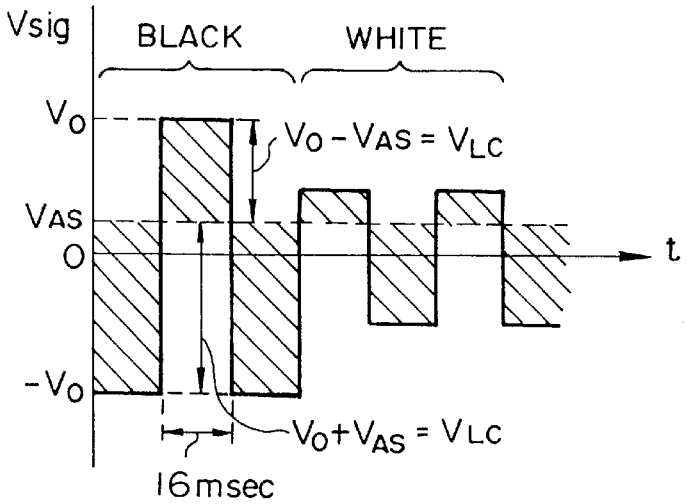
FIG. 8B is a waveform chart showing the driving signal in the conventional liquid crystal cell.
Figure 8C:
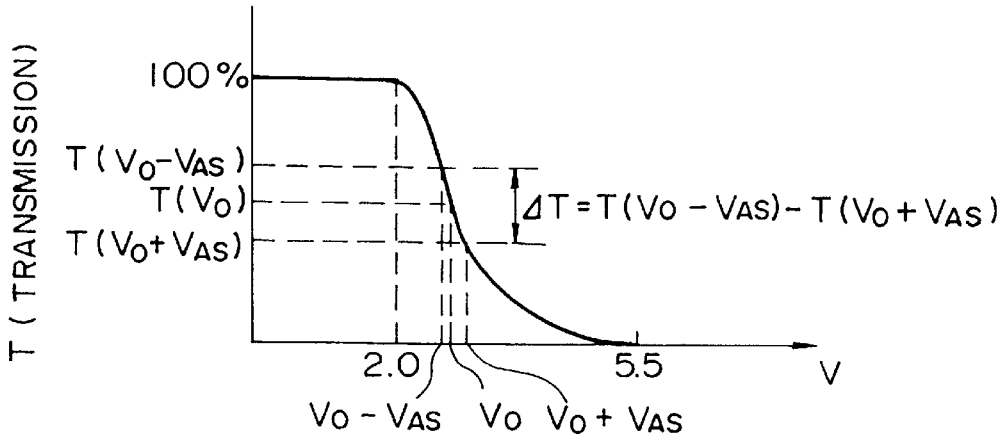
FIG. 8C is a graph showing the transmittance of the liquid crystal in the conventional liquid crystal cell.

FIGS. 6A to 6C show a condition in which the offset voltage whose polarity is the same as that of the asymmetric voltage $V_{AS}$ is applied to the liquid crystal. When the offset voltage is equal to the asymmetric voltage $V_{AS}$, asymmetry is offset and flickers disappear.

When the offset voltage equal to the asymmetric voltage $V_{AS}$,

Positive voltage applied to liquid crystal: $V_{LC}=V_0$

Negative voltage applied to liquid crystal: $V_{LC}=V_0$

Accordingly, a predetermined direct current voltage may be applied to the liquid crystal when the liquid crystal cell has been produced so that a predetermined quantity of ions are forced to be stuck, and the liquid crystal may be driven on condition that the offset voltage is applied.

Such a manner suppresses time-proportional changes from initial characteristics of the cell when an user begins to use it, so that its reliability as a product is improved.

In other words, when the liquid crystal cell is produced, ions are inevitably included in the liquid crystal, which ions become polarized to be absorbed by the electrode in the production process. Therefore, by estimating the absorption of the ions in advance and by forcing more ions than the ions absorbed in the process to be absorbed, the offset voltage can be readily determined in accordance with asymmetric voltage caused by the forced ion absorption, so that the affection of absorbed ions to the cell can be eliminated.

To force the liquid crystal cell to have ion sticking, the cell is heated at approximately 60° C. to one hundred several tens ° C., and a direct current voltage of approximately several tens to several hundreds volts is applied to the cell.

Further, by providing an offset-voltage controller in the cell, a condition of the cell affected by the stuck ions after the cell is produced can be eliminated by adjusting the offset voltage with this controller.

What is claimed is:

1. A liquid crystal display device having a pair of substrates, one of which is provided with a thin-film-transistor circuit, the other of which is provided with a common electrode, with liquid crystal provided between the substrates, said thin-film-transistor circuit including thin-film-transistors and pixel electrodes in regions surrounded by both gate lines and source lines arranged in the form of a matrix, said liquid crystal display device comprising a driving circuit which provides an electric signal having a voltage to said liquid crystal at a time of inverse driving and has one of a positive and negative polarity over one of plural frames and plural fields at the time of driving, wherein said driving circuit has a signal line driving circuit in which a voltage applied to said pixel electrodes is one of a high voltage and a low voltage over one of plural frames and plural fields, a voltage applied to said common electrode is a fixed voltage, and over the one of plural frames and plural fields: polarities of the voltages applied to the pixel electrodes remain unchanged regardless of whether the high or low voltage is applied with respect to the voltage applied to the common electrode and with respect to a voltage applied to the gate lines during a holding period, and the polarities of the voltages applied to the pixel electrodes with respect to the common electrode opposite to the polarities of the voltages applied to the pixel electrodes with respect to the gate lines during the holding period, and wherein a voltage of said electrical signal applied to the liquid crystal for displaying black differs from a voltage of said electrical signal applied to the liquid crystal for displaying white.

2. A liquid crystal display device of claim 1, wherein the voltage applied to the liquid crystal for displaying white is larger in magnitude than the voltage applied to the liquid crystal for displaying black with respect to the voltage applied to the gate lines during the holding period.

3. A liquid crystal display device of claim 1, wherein the voltage applied to the liquid crystal for displaying black and the voltage applied to the liquid crystal for displaying white retain the same polarity over plural fields, the voltages of adjacent fields within the plural fields displaying black are substantially identical and the voltages of adjacent fields within the plural fields displaying white are substantially identical.

4. A liquid crystal display device of claim 1, wherein the voltage applied to the liquid crystal for displaying black is about 4/11 of the voltage applied to the liquid crystal for displaying white with respect to the voltage applied to the common electrode over the one of plural frames and plural fields.

5. A liquid crystal display device of claim 1, wherein the voltage applied to the liquid crystal for displaying black is 10/17 of the voltage applied to the liquid crystal for displaying white with respect to the voltage applied to the gate lines during the holding period over the one of plural frames and plural fields.

6. A liquid crystal display device of claim 1, wherein the voltage applied to the liquid crystal for displaying black is about 5.5V and the voltage applied to the liquid crystal for displaying white is about 2V with respect to the voltage applied to the common electrode over the one of plural frames and plural fields.

7. A liquid crystal display device of claim 1, wherein the voltage applied to the liquid crystal for displaying black is about 5V and the voltage applied to the liquid crystal for displaying white is about 8.5V with respect to the voltage applied to the gate lines during the holding period over the one of plural frames and plural fields.

8. A liquid crystal display device of claim 1, wherein the voltage applied to the liquid crystal for displaying black and the voltage applied to the liquid crystal for displaying white are about 10/21 and about 17/21, respectively, of the voltage applied to the common electrode with respect to the voltage applied to the gate lines during the holding period over the one of plural frames and plural fields.

9. A liquid crystal display device of claim 1, wherein a current applied to a gate line for displaying black and for displaying white are substantially the same during the holding period.

10. A liquid crystal display device of Claim 9, wherein the currents are about 1 pA.

11. A liquid crystal display device having a pair of substrates, one of which is provided with a thin-film-transistor circuit, the other of which is provided with a common electrode, with liquid crystal provided between both substrates, said thin-film-transistor circuit including thin film transistors and pixel electrodes in regions surrounded by both gate lines and source lines arranged in the form of a matrix, said liquid crystal display device comprising a driving circuit which provides an electric signal having a voltage to said liquid crystal at a time of inverse driving and has one of a positive and negative polarity over all frames at the time of driving, wherein said driving circuit has a signal line driving circuit in which a voltage applied to said pixel electrodes is one of a high voltage and a low voltage over all frames, a voltage applied to said common electrode is a fixed voltage, and over all frames: polarities of the voltages applied to the pixel electrodes remain unchanged regardless of whether the high or low voltage is applied with respect to the voltage applied to the common electrode and with respect to a voltage applied to the gate lines during a holding period, and the polarities of the voltages applied to the pixel electrodes with respect to the common electrode opposite to the polarities of the voltages applied to the pixel electrodes with respect to the gate lines during the holding period, and wherein a voltage of said electrical signal applied to the liquid crystal for displaying black differs from a voltage of said electrical signal applied to the liquid crystal for displaying white.

12. A liquid crystal display device of claim 11, wherein the voltage applied to the liquid crystal for displaying white is larger in magnitude than the voltage applied to the liquid crystal for displaying black with respect to the voltage applied to the gate lines during the holding period.

13. A liquid crystal display device of claim 11, wherein the voltage applied to the liquid crystal for displaying black and the voltage applied to the liquid crystal for displaying white retain the same polarity over plural fields, the voltages of adjacent fields within the plural fields displaying black are substantially identical and the voltages of adjacent fields within the plural fields displaying white are substantially identical.

14. A liquid crystal display device of claim 11, wherein the voltage applied to the liquid crystal for displaying black is about 4/11 of the voltage applied to the liquid crystal for displaying white with respect to the voltage applied to the common electrode over all frames.

15. A liquid crystal display device of claim 11, wherein the voltage applied to the liquid crystal for displaying black is 10/17 of the voltage applied to the liquid crystal for displaying white with respect to the voltage applied to the gate lines during the holding period over all frames.

16. A liquid crystal display device of claim 11, wherein the voltage applied to the liquid crystal for displaying black is about 5.5V and the voltage applied to the liquid crystal for displaying white is about 2V with respect to the voltage applied to the common electrode over all frames.

17. A liquid crystal display device of claim 11, wherein the voltage applied to the liquid crystal for displaying black is about 5V and the voltage applied to the liquid crystal for displaying white is about 8.5V with respect to the voltage applied to the gate lines during the holding period over all frames.

18. A liquid crystal display device of claim 11, wherein the voltage applied to the liquid crystal for displaying black and the voltage applied to the liquid crystal for displaying white are about 10/21 and about 17/21, respectively, of the voltage applied to the common electrode with respect to the voltage applied to the gate lines during the holding period over all frames.

19. A liquid crystal display device of claim 11, wherein a current applied to a gate line for displaying black and for displaying white are substantially the same during the holding period.

20. A liquid crystal display device of claims 19, wherein the currents are about 1 pA.

21. A liquid crystal display device having a pair of substrates, one of which is provided with a thin-film-transistor circuit, the other of which is provided with a common electrode, with liquid crystal provided between both substrates, said thin-film-transistor circuit including thin film transistors and pixel electrodes in regions surrounded by both gate lines and source lines arranged in the form of a matrix, said liquid crystal display device comprising a driving circuit which provides an electric signal having a voltage to said liquid crystal at a time of inverse driving and has one of a positive and negative polarity over all frames at the time of driving, wherein said driving circuit has a signal line driving circuit in which a voltage applied to said pixel electrodes is one of a high voltage and a low voltage over all frames, a voltage applied to said common electrode is a fixed voltage, and over all frames: polarities of the voltages applied to the pixel electrodes remain unchanged regardless of whether the high or low voltage is applied with respect to the voltage applied to the common electrode and with respect to a voltage applied to the gate lines during a holding period, and the polarities of the voltages applied to the pixel electrodes with respect to the common electrode the same as the polarities of the voltages applied to the pixel electrodes with respect to the gate lines during the holding period, and wherein a voltage of said electrical signal applied to the liquid crystal for displaying black differs from a voltage of said electrical signal applied to the liquid crystal for displaying white.

22. A liquid crystal display device of claim 21, wherein the voltage applied to the liquid crystal for displaying white is smaller in magnitude than the voltage applied to the liquid crystal for displaying black with respect to the voltage applied to the gate lines during the holding period.

23. A liquid crystal display device of claim 21, wherein the voltage applied to the liquid crystal for displaying black and the voltage applied to the liquid crystal for displaying white retain the same polarity over plural fields, the voltages of adjacent fields within the plural fields displaying black are substantially identical and the voltages of adjacent fields within the plural fields displaying white are substantially identical.

24. A liquid crystal display device of claim 21, wherein a current applied to a gate line for displaying black and for displaying white are substantially the same during the holding period.

* * * * *